US008910828B2

(12) United States Patent
Kanderka et al.

(10) Patent No.: US 8,910,828 B2
(45) Date of Patent: Dec. 16, 2014

(54) SMALL VOLUME CONTAINER

(75) Inventors: John S. Kanderka, Priddis (CA); Dean Vincent Borschneck, Irricana (CA)

(73) Assignee: CLIC Enterprises Inc., Priddis, Alberta (CA)

( * ) Notice: Subject to any disclaimer, the term of this patent is extended or adjusted under 35 U.S.C. 154(b) by 0 days.

(21) Appl. No.: 13/093,290

(22) Filed: Apr. 25, 2011

(65) Prior Publication Data

US 2011/0259888 A1 Oct. 27, 2011

Related U.S. Application Data

(60) Provisional application No. 61/328,036, filed on Apr. 26, 2010.

(51) Int. Cl.

| | |
|---|---|
| ***B67B 7/00*** | (2006.01) |
| ***B65B 3/02*** | (2006.01) |
| ***B65D 5/54*** | (2006.01) |
| ***B65D 5/02*** | (2006.01) |
| ***B65B 61/02*** | (2006.01) |
| ***B65B 7/18*** | (2006.01) |
| ***B65B 1/02*** | (2006.01) |
| ***B65B 61/18*** | (2006.01) |
| ***B65D 75/58*** | (2006.01) |

(52) U.S. Cl.

CPC . *B65B 61/18* (2013.01); *B65B 3/02* (2013.01); *B65D 5/542* (2013.01); *B65D 5/029* (2013.01); *B65B 61/02* (2013.01); *B65B 7/18* (2013.01); *B65B 1/02* (2013.01); *B65D 75/5816* (2013.01); *B65D 75/5805* (2013.01)

USPC ..... 222/1; 222/541.6; 426/122

(58) Field of Classification Search

CPC .. B65D 5/4266; B65D 5/5425; B65D 5/5415; B65D 75/5816; B65D 75/5805; B65B 61/18

USPC ..... 222/81, 541.4, 541.7, 541.9, 1, 107, 92; 229/216, 242, 248; 383/207–209; 426/108, 122, 123

See application file for complete search history.

(56) References Cited

U.S. PATENT DOCUMENTS

| | | | | | |
|---|---|---|---|---|---|
| 2,227,341 | A | * | 12/1940 | Greenwood | 229/200 |
| 2,270,236 | A | * | 1/1942 | Blakemore | 229/104 |

(Continued)

FOREIGN PATENT DOCUMENTS

| | | | | |
|---|---|---|---|---|
| GB | 466947 | | 6/1937 | |
| GB | 793729 | * | 4/1958 | 229/200 |
| WO | WO 97/34816 | * | 9/1997 | 206/851 |

OTHER PUBLICATIONS

Official Action for U.S. Appl. No. 13/625,937, mailed Apr. 30, 2013 10 pages.

(Continued)

*Primary Examiner* — Lien Ngo
(74) *Attorney, Agent, or Firm* — Sheridan Ross P.C.

(57) ABSTRACT

A single-use storage and dispensing container is provided for use with small volumes of consumer products. The container is generally sleeve-like, sealed at both ends to contain the flowable material, and is scored or otherwise includes a break point for rupture by a user to dispense the container contents. Application of a threshold pressure to the container by the user will cause the container to rupture at the break point, dispensing flowable material therefrom. The container is suitable for one-handed use. Various cross sectional shapes of the sleeve are possible.

16 Claims, 11 Drawing Sheets

(56) References Cited

U.S. PATENT DOCUMENTS

| | | | | | |
|---|---|---|---|---|---|
| 2,369,716 | A | * | 2/1945 | Coghill | 493/189 |
| 2,436,981 | A | | 3/1948 | Sullivan | |
| 2,499,313 | A | * | 2/1950 | Hoag | 222/129 |
| 2,923,404 | A | * | 2/1960 | Adell | 206/525 |
| 3,067,870 | A | | 12/1962 | Bilsky | |
| 3,216,562 | A | * | 11/1965 | Lockwood | 206/532 |
| 3,473,650 | A | * | 10/1969 | Hoag | 383/200 |
| 3,741,384 | A | * | 6/1973 | Cloud | 206/461 |
| 3,795,359 | A | * | 3/1974 | Rausing | 229/216 |
| 4,301,927 | A | * | 11/1981 | Carlsson et al. | 229/216 |
| 4,358,028 | A | * | 11/1982 | Chiquiar-Arias | 222/107 |
| 4,450,581 | A | * | 5/1984 | Hirata | 383/42 |
| 4,634,008 | A | * | 1/1987 | Strole et al. | 229/216 |
| 4,644,732 | A | * | 2/1987 | Morton | 53/412 |
| 4,765,518 | A | * | 8/1988 | O'Meara | 222/541.9 |
| 5,595,340 | A | * | 1/1997 | Skinner | 229/216 |
| 5,601,233 | A | * | 2/1997 | Kageyama et al. | 229/216 |
| 6,085,942 | A | * | 7/2000 | Redmond | 222/107 |
| 6,094,886 | A | * | 8/2000 | Poignant | 53/412 |
| 6,193,416 | B1 | * | 2/2001 | Kawamata et al. | 383/104 |
| 6,267,507 | B1 | * | 7/2001 | de Laforcade | 383/200 |
| 6,446,860 | B1 | * | 9/2002 | Robichaud | 229/216 |
| 6,638,549 | B1 | * | 10/2003 | Lloyd | 426/115 |
| 7,073,692 | B2 | * | 7/2006 | Weyts | 222/541.9 |
| 7,270,239 | B1 | * | 9/2007 | Ross | 206/581 |
| 8,091,242 | B2 | * | 1/2012 | Teys et al. | 30/324 |
| 2008/0273821 | A1 | * | 11/2008 | Doll | 383/209 |
| 2010/0116772 | A1 | * | 5/2010 | Teys | 215/228 |

OTHER PUBLICATIONS

U.S. Appl. No. 13/625,937, filed Sep. 25, 2012, Kanderka et al.
Official Action for U.S. Appl. No. 13/625,937, mailed Aug. 22, 2013 15 pages.
Official Action for U.S. Appl. No. 13/625,937, mailed Mar. 4, 2014 13 pages.

* cited by examiner

SMALL VOLUME CONTAINER

REFERENCE TO RELATED APPLICATIONS

This application claims the benefit of U.S. Provisional Application No. 61/328,036 which was filed on Apr. 26, 2010.

FIELD OF THE INVENTION

The present invention relates generally to small volume containers. More particularly, the present invention relates to a single use container for storing and dispensing flowable materials.

BACKGROUND OF THE INVENTION

The demand for single use packaging of consumer products is ubiquitous, penetrating the food, automotive, aerospace, pharmaceutical, and personal care industries in particular. Flowable products such as salt, sugar, milk, creamer, ketchup, vinegar, jam, honey, perfume, oil, lotion, soaps, sanitizers, powders, makeup, auto car cleaners, lubricants, catalytic products, hand sanitizers, and gels are all currently available in individual-size, single use packages. Generally, liquid, cream and gel products are packaged in flaccid foil wrapping to preserve freshness, while flowable solids are typically packaged for single use in a paper envelope. While these forms of packaging are inexpensive and easily manufactured, they are deemed inconvenient to the user in opening and dispensing product.

For example, a user dispensing ketchup from a foil envelope typically will require both hands to open the package. Alternatively, one-handed opening is possible with assistance from the user's teeth. In either case, dispensing ketchup from the torn foil package is messy, and the user will likely end up with ketchup on at least a few fingers of one hand. In addition, it is typical that ketchup will also leak onto the outside of the package. Placement of the sloppy package on a nearby counter or table will result in further mess to the table, providing potential for bacterial growth and cross contamination.

Paper envelopes for dispensing flowable solids are similarly inconvenient. Form example, a user attempting to add sugar to a cup of coffee will usually put the cup down on a table, or otherwise balance it, to free both hands to open the sugar package. The user tears the package, and is then found holding a shred of paper in one hand, and an open package of sugar in the other hand. The sugar is added to the coffee, and the paper in each hand is discarded. During this process, there is ample opportunity for the user or another individual to knock over the cup of coffee.

Further, safety is a major concern when handling hot, corrosive, acidic, or other hazardous materials, particularly while manipulating a container and operating a vehicle or otherwise performing a complicated task. In any of these situations, the potential exists for personal injury or property damage.

Waste is also an issue in our society. Sources of waste in small volume packages include incomplete evacuation of contents, spillage of contents, and property and environmental damage by spillage or improper dispensing of toxic materials. Discarded single use containers are also a source of visible trash worldwide.

Further, existing small volume single-use packages such as those mentioned above are generally not suited for long-term storage. For example, paper packages must be kept away from wetness, and perfume containers (typically made of glass) must be safely stored to avoid breakage.

SUMMARY OF THE INVENTION

It is an object of the present invention to obviate or mitigate at least one disadvantage of previous small volume containers.

In accordance with a first aspect of the invention, there is provided a single use storage container, the container comprising: one or more walls operatively connected to form an elongated sleeve, and having first and second closed ends; a rupture point proximal to at least one of said closed ends, the rupture point rupturable to provide a dispensing opening upon application of a threshold force by a user against the rupture point, wherein the threshold force is less than or equivalent to that exertable by a thumb of a user; the sleeve composed of a material having sufficient rigidity to resist bending during application of the threshold force by the user. The single use container may further comprise an advertising surface along the one or more walls.

In an embodiment, the sleeve is prismatic, having a triangular, rectangular, or ellipsoid cross sectional area.

In another embodiment, the rupture point is a score line about the sleeve. In particular embodiments, the score line may be created by thermal, mechanical, ultraviolet, or laser means.

In another embodiment, the rupture point comprises adhesive.

In some embodiments, the threshold force required to break or rupture the container and release the contents may be between 1 and 100N. In certain embodiments, the threshold force is less than 21N. The threshold force may be applied to the walls of the container in some embodiments, or to the end of end of the container in other embodiments.

One or both ends of the container may be sealed by folding, crimping, gluing, heating, application of pressure, or application of ultrasound.

In accordance with a second aspect of the invention, there is provided a single use container for storing flowable material, the container comprising: a sleeve having closable ends for supporting an amount of flowable material within the sleeve; and a break point along the sleeve, the break point defining a dispensing outlet through which flowable material may be released from the container upon application of a threshold force by a user against the break point; the sleeve formed from a semi-rigid material suitable to resist bending during application of the rupture force by a user.

In accordance with a third aspect of the invention, there is provided a method for storing and dispensing a flowable material comprising the steps of:

- providing a sleeve having a closed first end and open second end;
- filling the sleeve with a flowable material;
- sealing the second end to contain the flowable material within the sleeve; and
- providing a break point along the sleeve, thereby defining a rupture location for use in dispensing material from the container; and
- applying a threshold force against the break point to rupture the sleeve and dispense material from the container at the rupture location;
- the sleeve formed of material having suitable rigidity to resist bending during application of the threshold force.

In an embodiment, the step of providing a sleeve comprises folding and gluing one or more sheets of material into a prismatic form, and sealing the prismatic form at a first end to form a sleeve having a closed first end and open second end.

In another embodiment, the step of sealing the second end comprises folding, crimping, gluing, heating, application of pressure, or application of ultrasound.

In a further embodiment, the step of providing a break point comprises forming a score line along the sleeve. The score line may be created, for example, by thermal, mechanical, ultraviolet, or laser means.

The method may further comprise the step of printing an advertisement on the sleeve.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figures 1A, 1B, 1C, 1D, 1E:
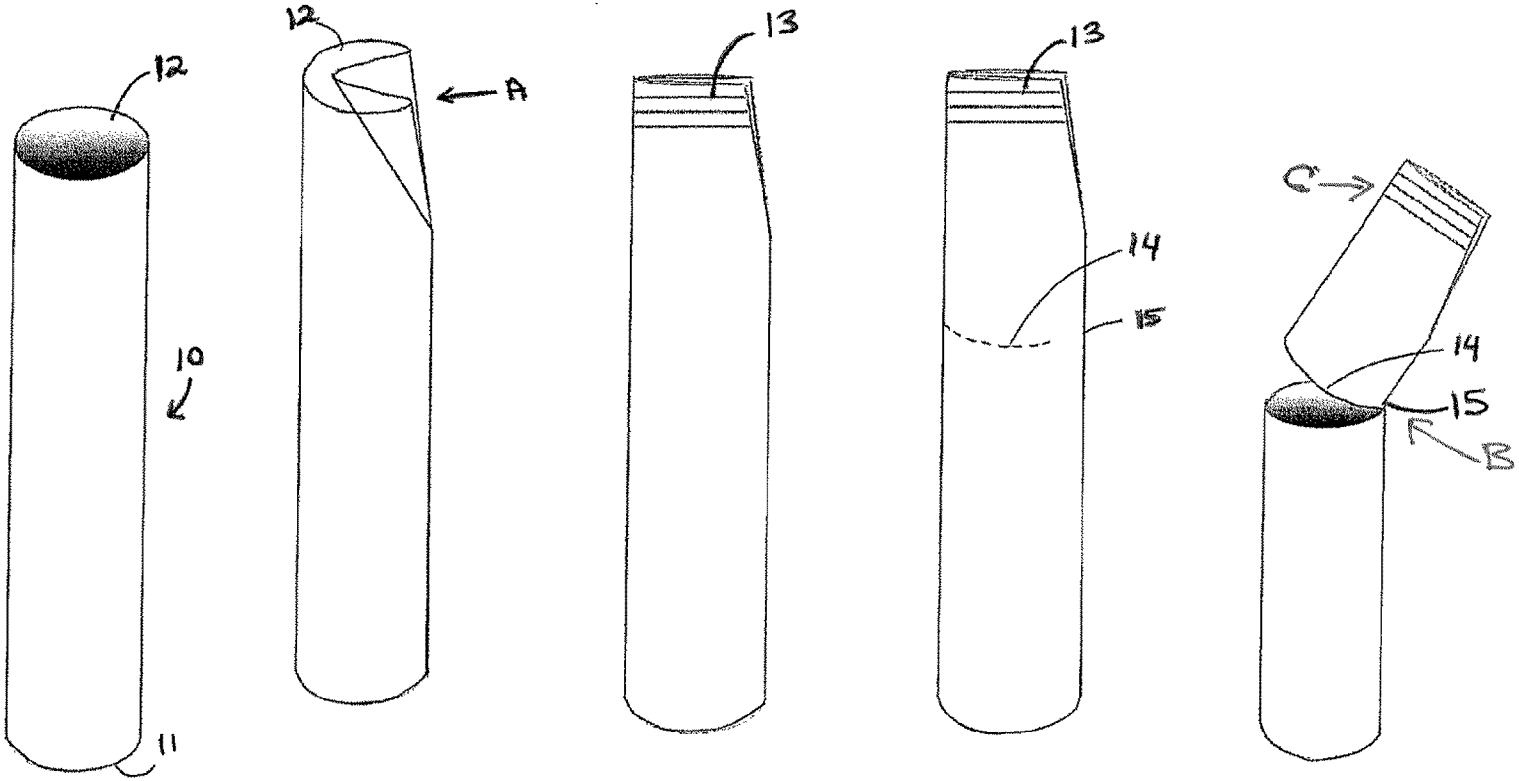
FIG. 1*a-e* are schematic perspective views depicting steps in the formation and rupture of a cylindrical, single-use container.

Generally, with reference to the Figures, a small-volume container is described for storage and one-time dispensing of flowable materials. The container may be inexpensively manufactured, filled, and sealed until the time of desired use by the consumer.

The container may be manufactured as a length of semi-rigid tubing having suitable cross-sectional shape and size, made from any suitable material. The tubing is sealed at one end to form a receptacle for containing flowable material. The receptacle is filled, and the open end is sealed to store the material inside. A score or other weak point in the container is created before or after filling, along or about the length of tubing. This score, or weak point, will rupture or otherwise open upon application of manual pressure to the closed tubing, forming a dispensing opening. It is intended that the shape and size of the container will fit comfortably in a user's hand, and the score will easily rupture upon application of pressure by the user's thumb and/or forefinger. That is, the angular deflection of the container wall along the score line or weak point, caused by application of opposing manual pressure to the container ends by the user, will rupture the container along the score line, creating an opening through which flowable container contents may be dispensed. Accordingly, the user may effect one handed opening and dispensing of the flowable material from the container.

Sleeve

The material used to manufacture the container may be stiff paper, polyethylene, polypropylene, plastic-backed foil, or any other suitable material. The sleeve or tubing may be recyclable, and/or formed of biodegradable or recycled materials. To date, suitable tested materials have included cardboard, flexible plastic (containing polyethylene, nylon, or polyester), rigid plastic (polypropylene)

The material should provide some flexibility to allow deformation of the ends for sealing purposes, while also providing some rigidity and resiliency to prevent premature breakage of the filled and sealed container. In addition, if scoring is desired, the material should be reliably scorable to allow consistent rupture by a typical user. The combination of material selection, container configuration, and depth/type of scoring will provide a container of sufficient rigidity to rupture the score upon application of reasonable pressure by a user.

Accordingly, criteria for use in selection of an appropriate manufacturing material should include consideration of the modulus of elasticity—ease of breaking the material, and the material's rigidity—ability to resist bending as a breaking force is applied. Generally, as failure Additional criteria may include toxicity, printability, and compatibility with proposed flowable material to be contained, biodegradability, cost of the material, and cost to form the container from the material.

Examples of suitable cross sectional tubing shapes are shown in the figures. It is well known that cylindrical lengths of tubing may be manufactured. Angular cross sectional shapes (such as triangular, square, rectangular, etc) may be desirable to allow stacking of the containers, to avoid rolling of the filled or empty containers across surfaces, and for ease of manipulation by the user in opening the container. Further, in certain applications, unique cross sectional shapes may be desirable for product or supplier branding, etc. For example, it may be desirable to have a stackable container with flat panels to which a logo may be applied, such that when pluralities of such containers are stacked, the logos are clearly visible.

Manufacture of Receptacle

With reference to FIGS. 1*a* through 1*e*, a container 10 of cylindrical cross section is formed with a closed bottom 11 and open top 12, so as to form a sleeve-like receptacle for flowable material.

Alternatively, the container may be initially produced as a length of tubing, which is later cut to appropriate length and sealed at one end to form the closed bottom 12. Such tubing may be formed as is known generally in the art, for example by helically wrapping sheets of suitable material about a central form, or by seam bonding, tab or overlap bonding, injection molding, or extrusion. Each container is cut from the length of tubing and sealed at one end to create an open container. This sealing is typically accomplished by folding, crimping, and/or bonding of one open end. The resulting closed bottom may then be flattened or flared if desired (for example, as shown in FIGS. 5 and 6) to allow the container to stand on end. This flaring may be accomplished, for example, by stretching the closed bottom to appropriate shape, or by addition of a flared base beneath the closed bottom. As shown in FIGS. 5*c* and 6*c*, the closed bottom (51 or 61, respectively) may instead be formed within the sleeve 50, 60, and the sleeve extends past the closed bottom to form a flared base 52, 62 suitable to support the container in a standing position upon a surface.

Figure 4A:
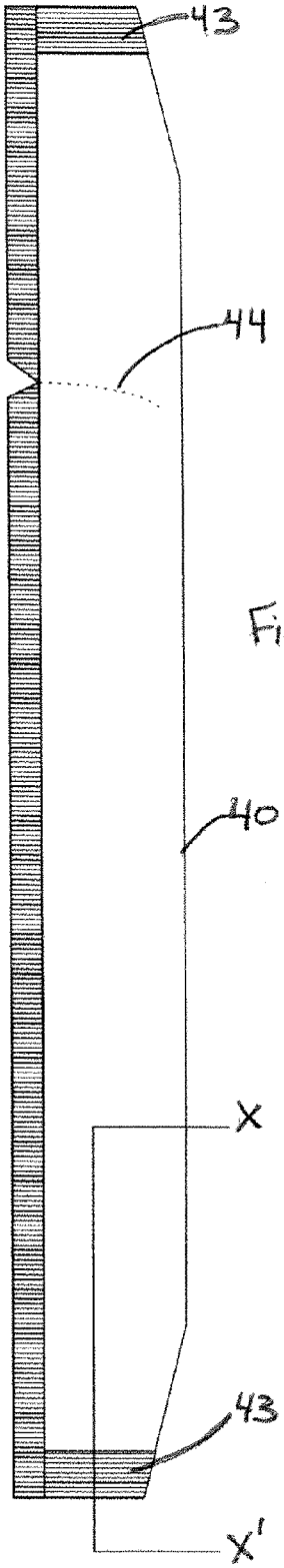
FIG. 4*a-c* are side, top, and cross sectional (through X-X') views, respectively, of a single use container crimp-sealed at both ends.
Figure 4B:
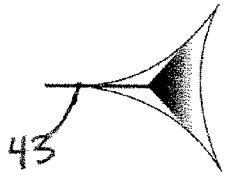
Figure 4C:
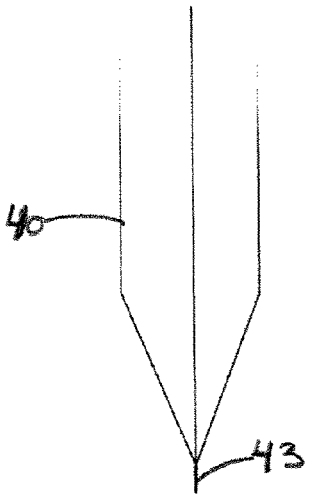

With reference to FIGS. 4*a, b*, and *c*, both ends of the sleeve 40 are folded and crimped 43 to seal the flowable material within the container. Accordingly, the closed ends 43 are formed by crimping and/or bonding of the sleeve to itself.

Figure 5A:
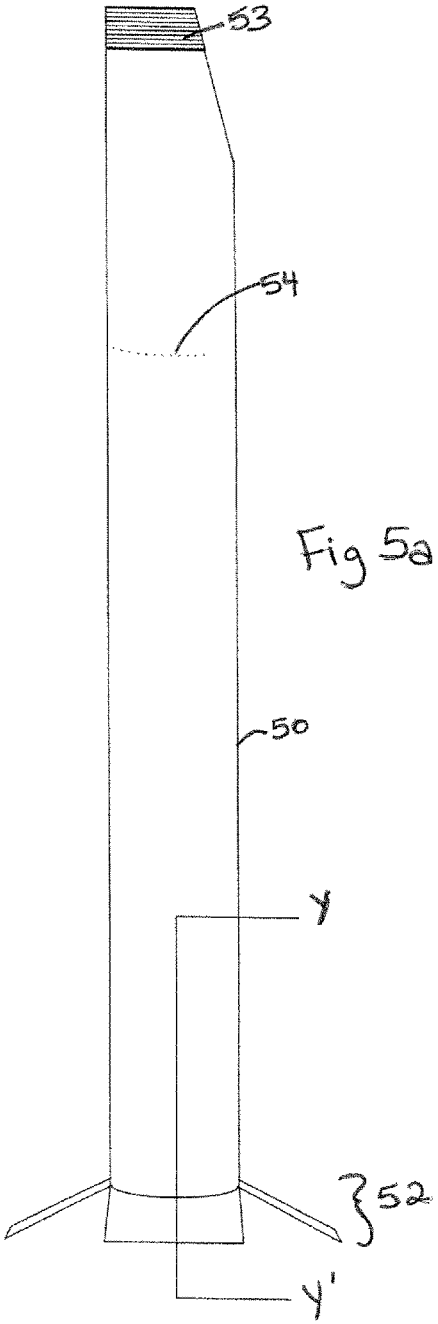
FIG. 5*a-c* are side, top, and cross sectional (through Y-Y') views, respectively, of a flared-bottom single use container.
Figure 5B:
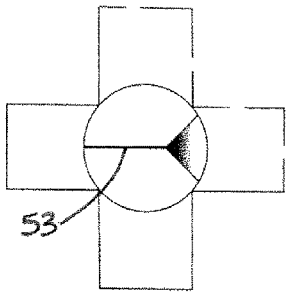
Figure 5C:
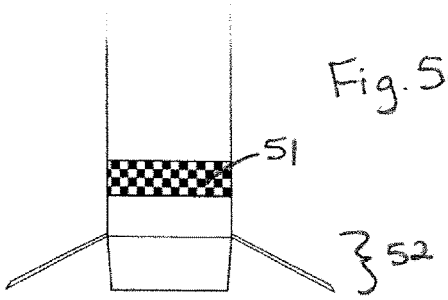

With reference to FIGS. 5*a, b*, and *c*, a closed bottom 51 is formed by insertion of a plug within the sleeve 50. The plug is sealed to the sleeve to prevent leakage of flowable material when filled. A portion of the sleeve extends past the closed bottom 51, is slit, and may be folded/flared outwardly—either prior to filling, or by the user prior to dispensing. This flaring, for example to tripod form as shown, will provide some stability in standing on end.

Figure 6A:
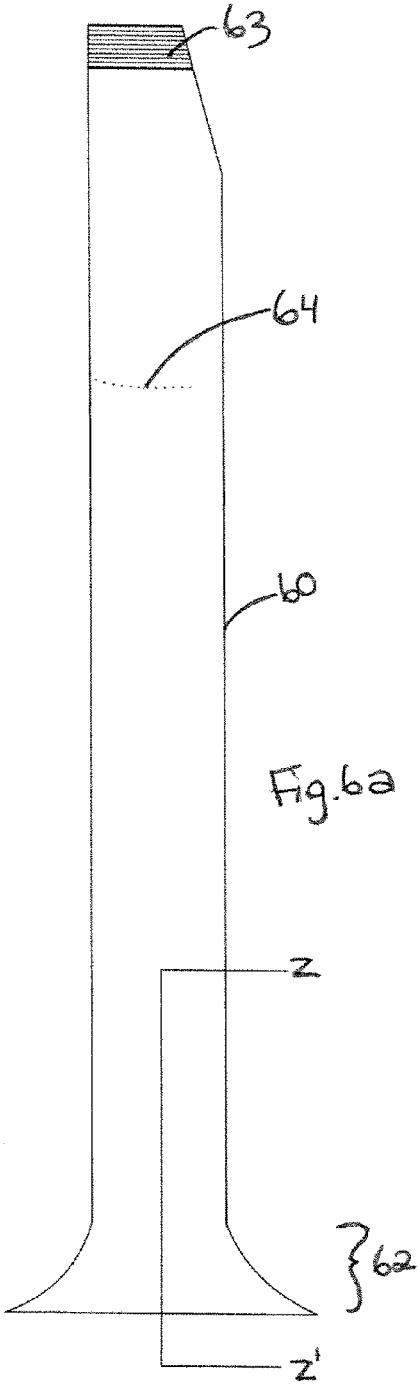
FIG. 6*a-c* are side, top, and cross sectional (through Z-Z') views, respectively, of a flared-bottom single use container.
Figure 6B:
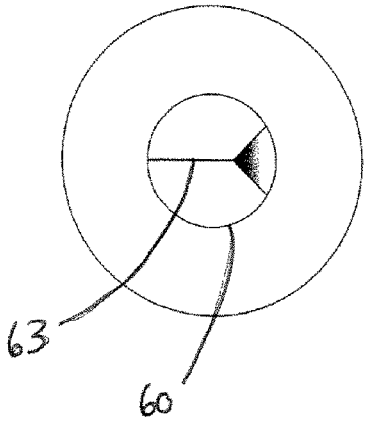
Figure 6C:
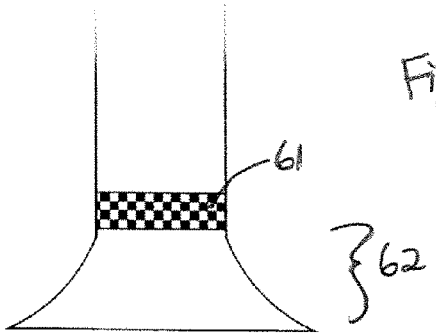

With reference to FIGS. 6*a, b*, and *c*, the closed bottom 61 is similarly formed by plugging the sleeve 60, and the extending sleeve portion is flared, for example by heating and stretching of the end of the sleeve, thereby forming flared bottom 62.

The containers shown in the drawings may be economically manufactured, as each container is formed as a single unit, without need for attachment of additional closures, valves, etc.

Sealing, and Scoring of the Container

With reference to FIG. 1, a container 10 is filled with an appropriate volume of the desired flowable material, and the top of the container is sealed. One method of sealing the open top 12 (and similarly, for closing the bottom 11 in certain embodiments) is shown in FIGS. 1*b* and 1*c*, in which the open top 12 is depressed inward A, and folded on itself, followed by sealing of the fold 13. To facilitate opening by the user, a score line is created along the container. As shown in FIG. 1*d*, the score line 14 extends about the circumference of the container 10 but need not fully extend around the entire circumference. Therefore, the unscored portion 15 about the circumference provides a bracing position for exertion of pressure B, while deflecting the score line by applying opposing pressure C at the end of the container, to break the container open along the score line 14, dispensing the flowable material. The unscored portion 15 also acts as a hinge opposite the score 14, preventing complete separation of the resulting container portions upon opening.

The score about the container may be made proximal one or both ends. When the closed end is flared or flattened, the score may be placed proximal the opposite end such that tapping the flared end, or standing the container on its flared or flattened end, will cause the contents to settle within the container, below the score. This will minimize spillage when the score is broken.

Accordingly, the user may tap the container to settle the material within the container such that the material settles below the score line, and then rupture the container open at the score line by applying pressure B to the unscored portion 15, with opposing pressure C exerted at the end of the container. As shown in FIG. 1*e*, the container will break along the score line, without separating the two portions of the container 10. Thus, the user requires only one hand to break open the container, dispense material, and discard the container.

Scoring a container to provide a defined opening/dispensing location may be accomplished by etching, notching, perforating, etc. using thermal, mechanical, ultraviolet, laser, or other means to weaken the container at a defined location. This weakened location provides a break point upon the application of pressure to the container walls, such that the container will split at the score to allow dispensing of material from the container.

More than one score may be made about/along the container. For example, a score could be made adjacent each end of the container. Alternatively, as shown in FIG. 2*g*, a notch may serve as an appropriate score along the container wall. Similarly, the folding or sealing of the container may be adjusted or customized to provide an appropriate score location.

The open top 12 may be sealed by any suitable method. For example, and as shown in the Figures, the top may be sealed by folding and crimping the walls together. Additional sealing may be provided by glue, heat-sealing, or ultrasonic radiation.

During sealing, the container may be pressurized to assist rupture along the score line by the user. Depending on the contents, container construction, and materials, the container may be positively or negatively pressurized with an appropriate additive (for example an inert gas), which may serve a dual purpose in preservation or masking of odour as desired.

Opening

The filled and sealed container may be opened by applying opposing pressure to, or flexing, the container—causing it to split along the score line. The container design facilitates opening without bimanual synergy. That is, the user may open the container with one hand while holding another item (for example a cup of coffee) in the other hand.

With reference to FIG. 3, a user grasps the lower portion of the container with the fingers of one hand, and applies pressure with the thumb of the same hand against the top of the container as shown by arrow C to force the score to split open, forming a dispensing opening. Alternatively, the user may press against the container behind the score line with a thumb as shown by B, while using a finger to pull on the top end in the opposite direction (C). The container will split open along the score line. If the score line does not extend about the entire circumference of the container, the unscored portion may serve as a hinge so the user may hold the score open wide to dispense the flowable contents.

It has been determined through user testing that the maximum desirable threshold force to open the container should be lower than 21N, to ensure ease of opening by any individual. That is, the container should require the user to exert no more than 21N of force to open the container.

Emptying

Once the container has been opened, the user may simply pour the flowable material from the container. Depending on the material, the user may wish to squeeze the container, applying additional pressure to fully eject the contents, particularly when the flowable material is highly viscous—such as honey, lotion, oil, or butter.

EXAMPLES

Example 1

With reference to FIGS. 1*a* through 1*e*, a container is shown having a cylindrical body. Typically, the small-volume, single-use container will be approximately 0.3 to 5.0 cm in diameter and 4.0 to 12.0 cm in length. A diameter of 0.25 inches to 0.75 inches and a length of 5 to 10 inches will be suitable in most circumstances. The score may be provided at any location along the container. In the Figures, the score is shown approximately one third of the distance from the top sealed end of the container.

Example 2

Figure 2D:
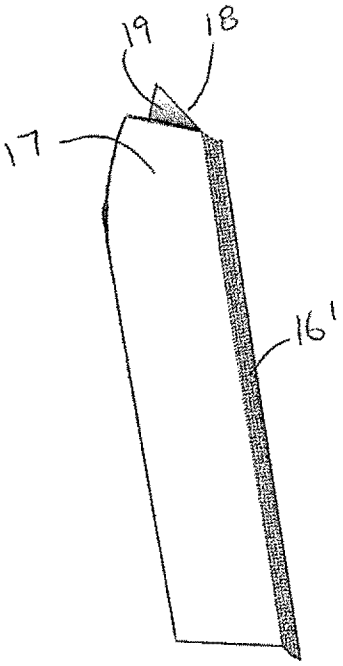
FIG. 2*a-h* are schematic perspective views depicting steps in the formation and rupture of a triangular, single-use container.
Figure 2C:
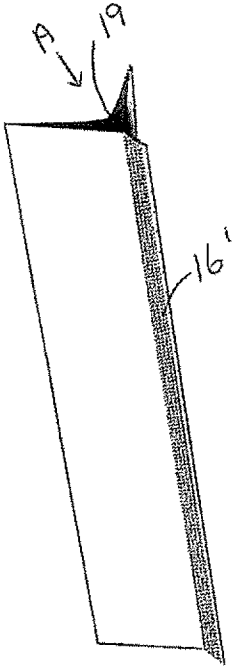
Figure 2B:
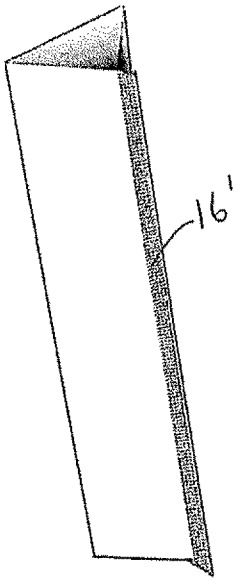
Figure 2A:
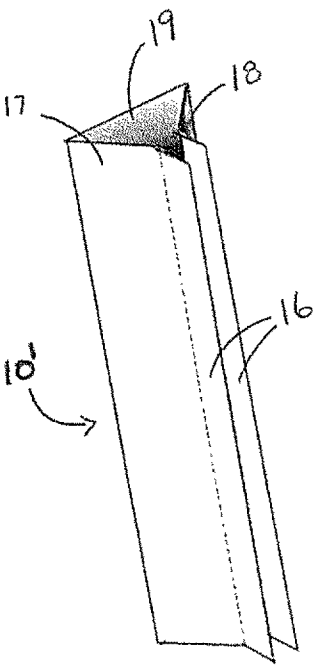
Figures 2E, 2F, 2G, 2H:
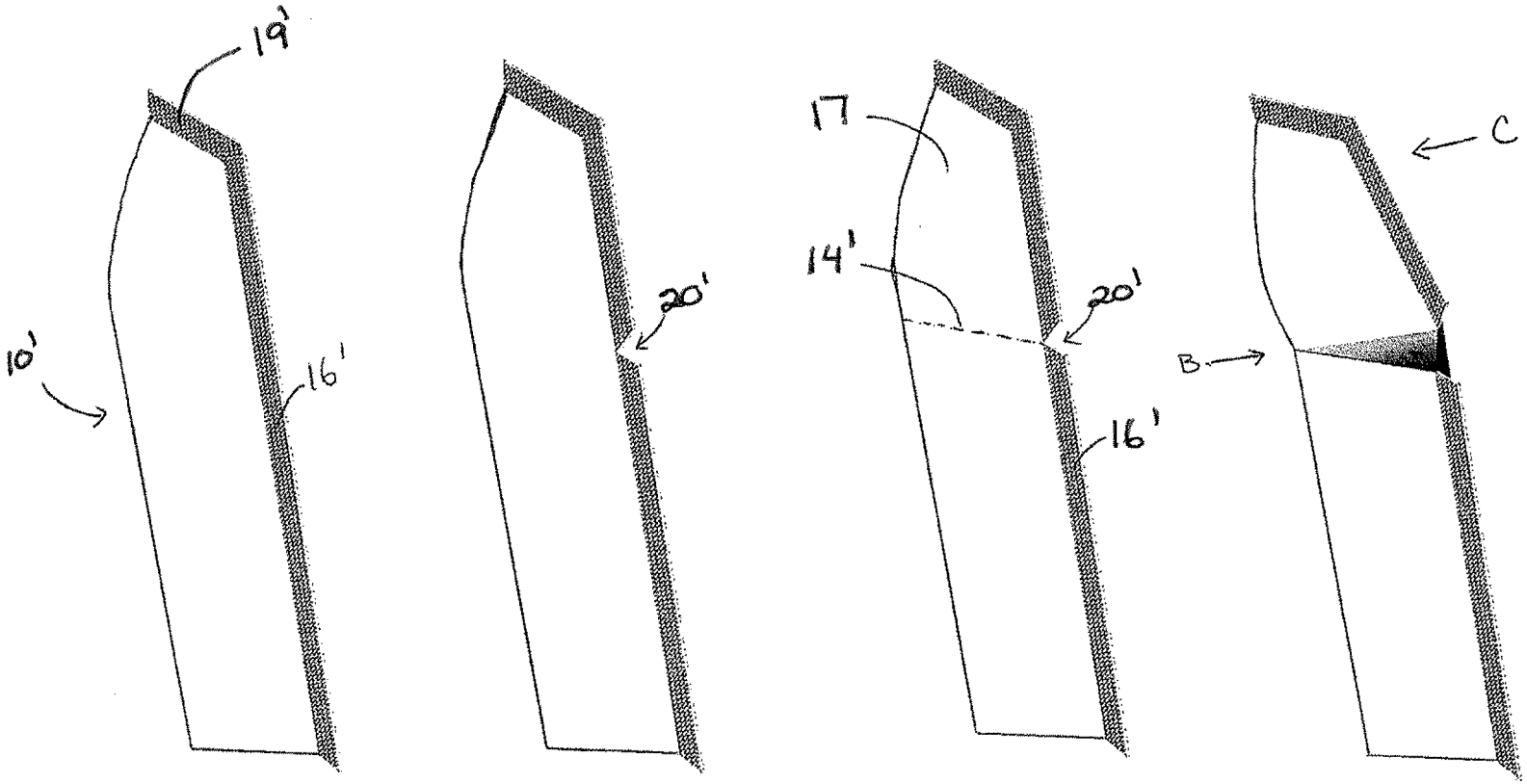

With reference to FIGS. 2*a* through 2*h*, the container 10' may be triangular in cross section. The triangular shape is formed from a folded single sheet of material, as shown in FIG. 2*a*, with tabs 16. Tabs 16 are sealed along the length of the sheet to form seam 16', securing the triangular form, defined by container walls 17, 18, 19. As shown in FIG. 2*c*, the top or bottom may be closed by depressing wall 19 inwardly A towards the seam 16'. Walls 17 and 18 are then brought together over depressed wall 19 as shown in FIG. 2*d*. The folds are bonded/sealed to secure the closure as shown in FIG. 2*e*, forming closure 19'. The opposing end of the container may be closed in a similar manner. As shown in FIG. 2*g*, a score 14 may be enhanced by placement of a notch 20', providing a weakened location at which the dispensing opening will form upon application of pressure by the user. That is, the user may apply pressure B to wall 19 behind the notch, while applying opposing pressure C to the seams 16', 19' above the notch, which will cause the container to split open at the notch, releasing flowable material from the opening. The application of these opening forces B, C, is shown in FIG. 2*h*, resulting in the container rupturing at the notch 20' and extending along the score line.

As shown in FIG. 2*g*, additional scoring 14' to walls 17 and 18 adjacent the notch may further facilitate rupture, depending on the properties of the material used to manufacture the container.

Example 3

Figure 3C:
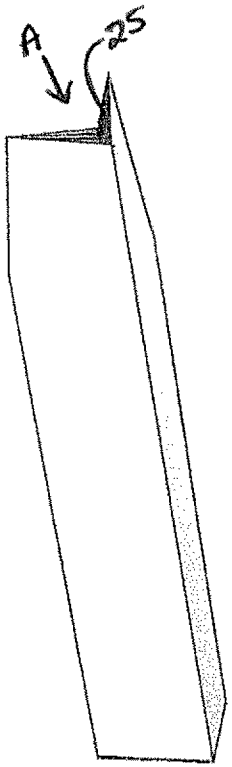
FIG. 3*a-f* are schematic perspective views depicting steps in the formation and rupture of a triangular, single-use container.
Figure 3B:
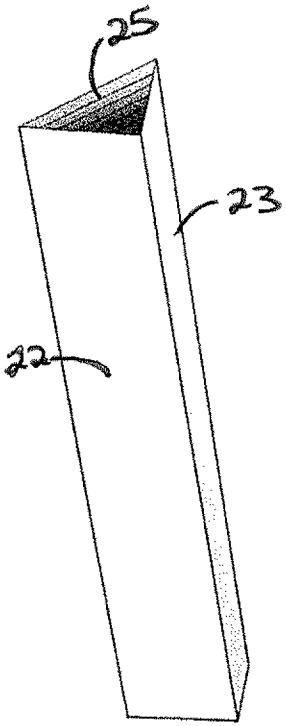
Figure 3A:
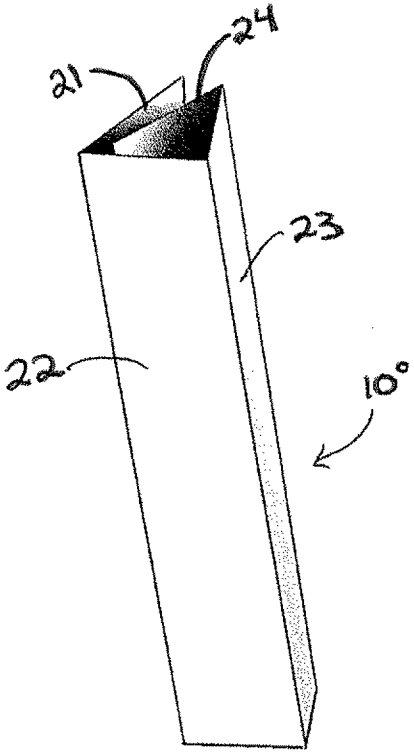
Figure 3F:
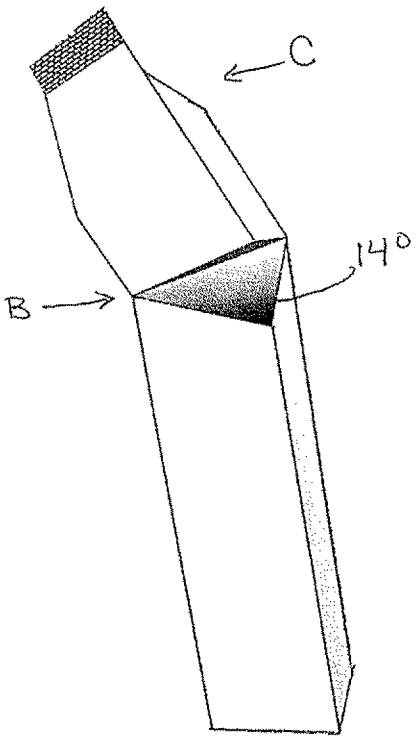
Figure 3E:
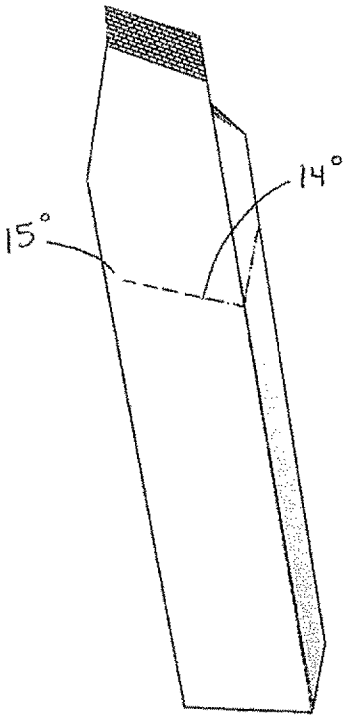
Figure 3D:
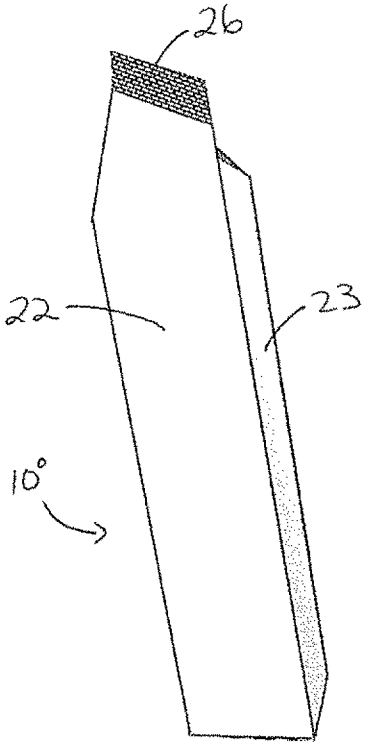

As a further example, another container 10° with triangular cross section is shown in FIGS. 3*a* through 3*f*. Container 10° is formed by folding a single sheet of material into triangular form, followed by sealing/bonding of overlapping walls 21 and 24 to form bonded wall 25. Bonded wall 25 is then depressed inwardly A at one end of the triangular tube, as shown in FIG. 3*c*. Walls 22 and 23 are then folded against each other over bonded wall 25, and the closure is sealed to form closed top 26, as in FIG. 3*d* through 3*f*. The opposing end of the container may be similarly closed. A score 14° is made along walls 22 and 23 as shown in FIG. 3*f*. Application of opening forces B, C, to the container 10° will open the container along the score line 14°.

Example 4

Figure 7:
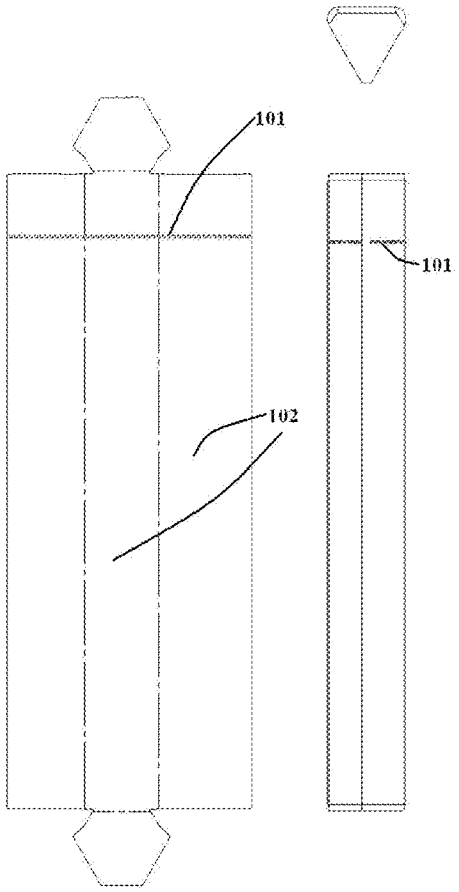
FIG. 7 is a schematic assembly view of a single use container, in one embodiment.
Figure 7:
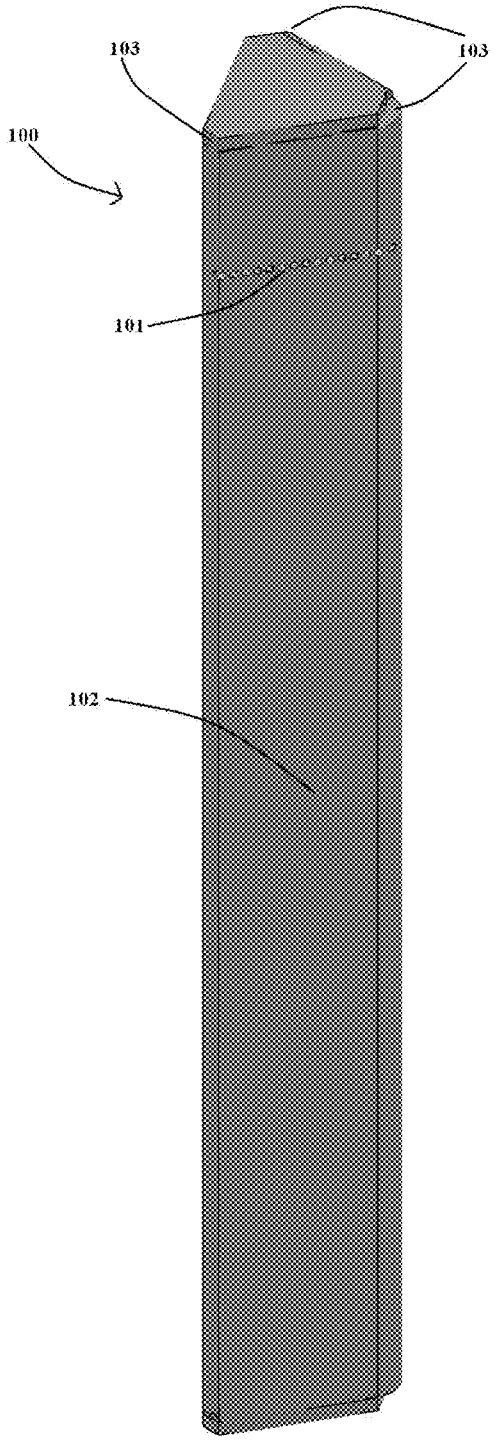

The sample container 100 shown in FIG. 7 resembles a triangular prism, having perforations 101 near one end to define the break point of the container. The container is formed by die-cutting a flat sheet of SBS board, which is then pressed through a series of rollers to fold the sheet into a triangular prism. Each face 102 of the prism is 100 mm in length, 12 mm in width, with a material thickness of 1 mm. Adhesive is applied along the edge of the sheet to secure the prismatic shape of the container, and one of the ends. The container is filled and a final adhesive application seals the container.

When opening of the container is desired, a user grips the container with the palm and fingers, and applies thumb force against an upper corner 103 of the triangular prism. In testing, the mean opening force was 5.2N, with a maximum force of 8.7N. This is less than 50% of the desirable threshold force of 21N. When opened in this manner, the break points along two faces of the container, with the third face (opposing the corner to which force was applied) remains intact and flexes to provide a hinge effect. Accordingly, the container can simply be tipped on end to dispense the contents.

In this embodiment, the triangular prism of SBS board provided suitable rigidity to prevent horizontal deflection failure. Given that the opening force is applied to the corner of the prism in this embodiment, and with a limited length lever arm and minimal opening force required, the bending moments are limited and the integrity of the container was maintained in all tests.

Example 5

Figure 8:
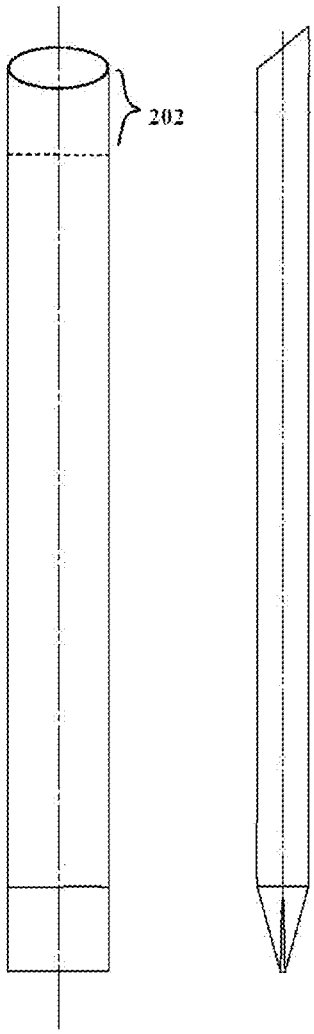
FIG. 8 is a schematic assembly view of a single use container, in one embodiment.
Figure 8:
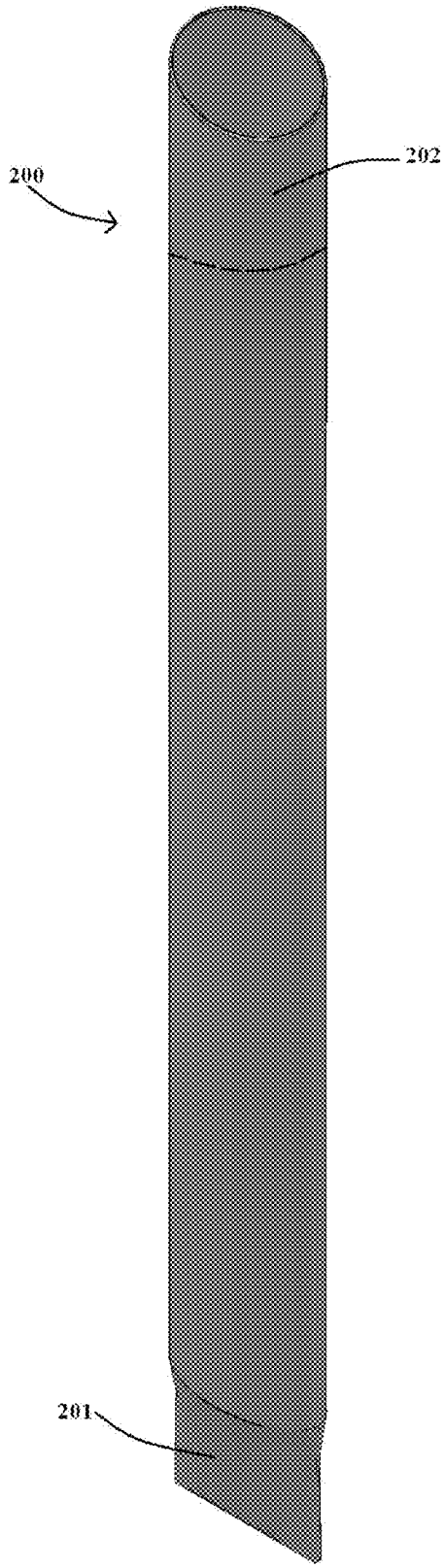

The sample container shown in FIG. 8 resembles an extruded ellipsoid or straw-like form with one end crimp-sealed and the opposing end folded over on itself.

The tube 200 shown in FIG. 8 is formed from extruded polylactic acid plastic having a thickness of 0.15 mm, each container having a total length of 110 mm per container, and a finished length of 100 mm. In the embodiment shown, the major finished diameter is 12 mm and the minor diameter is 6 mm.

The container can be formed using equipment similar to that used in the straw manufacturing industry. To form the container, one end is crimp-sealed 201 and the other end bears a 10 mm fold-over flap 202. That is, once the container is filled, the flap is folded over and the tip of the flap is bonded to the center of the ellipse with a point-applied adhesive, to result in a final length of 100 mm.

Opening is effected by application of an upward force against the folded flap, causing the flap to unseal and unfold, revealing the product inside, which can then be poured out. In testing, the mean opening force was 5.5N, with a maximum of 8.6N required to break the adhesive bond.

The minimal force required to effect opening of the container, combined with the upward direction of force application and limited lever arm, result in minimal bending moments applied in the horizontal direction. No horizontal deflection failure was observed in testing, and the material was determined to be suitably rigid to perform appropriately.

Example 6

Figure 9:
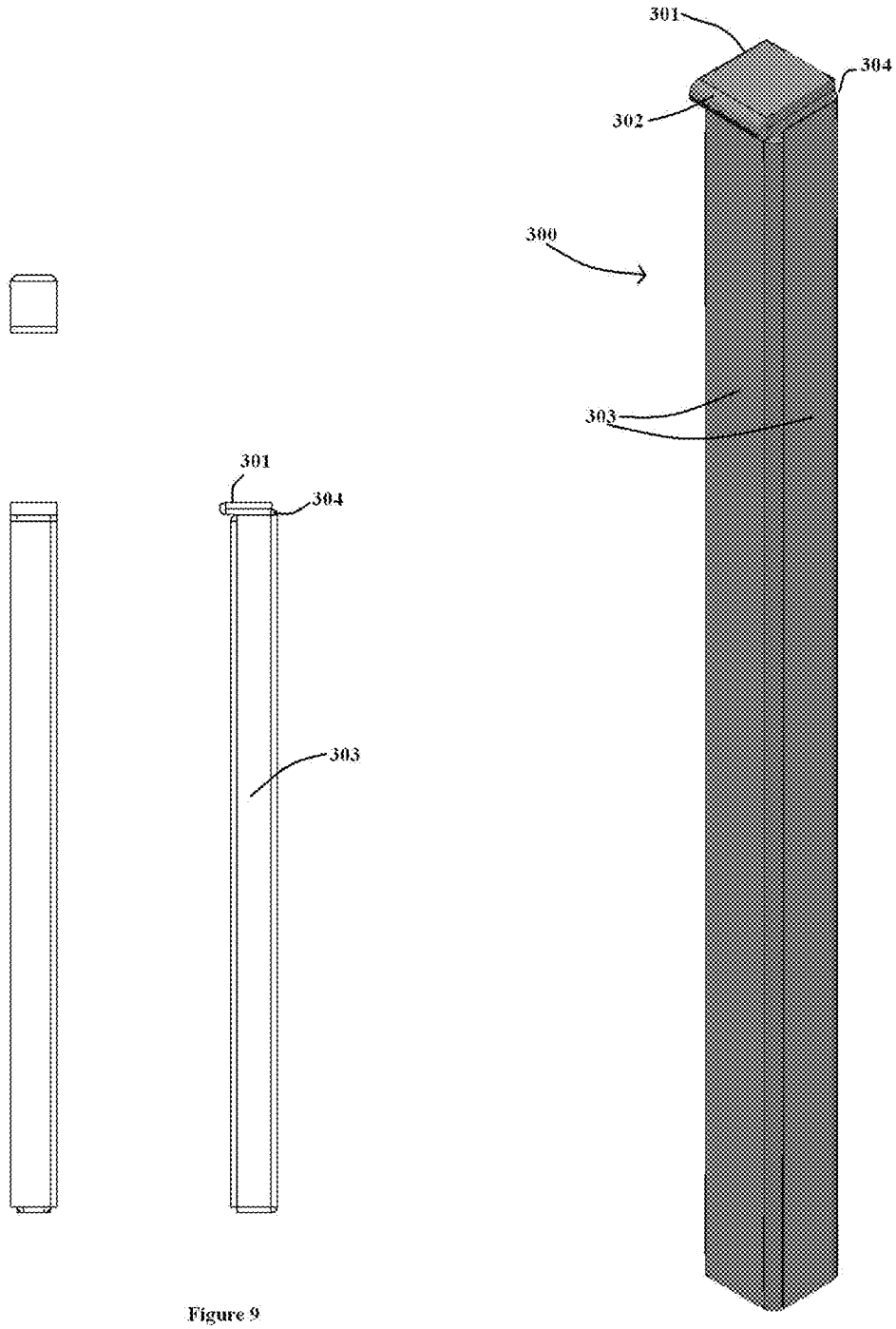
FIG. 9 is a schematic assembly view of a single use container, in one embodiment.

The example container 300 shown in FIG. 9 is formed as a rectangular prism, with each end closed by a folded flap 301. At least one of the flaps 301 bears a flap extension 302 extending past one side of the prism as shown, to which an opening force is applied by a user. Each rectangular face 303 has a length of 123 mm and a width of 8 mm. The folded end flap extends 1 mm past the opposing prism wall to provide a surface area for application of an opening force to the flap.

The rectangular prism shown was formed from a flat sheet of sugar cane paper 1 mm thick, to which a starch-based adhesive was applied. The paper was die-cut and fed into a folding apparatus, then secured with adhesive.

During testing, a mean upward force of 4.8N was established to open the container, with a maximum force of 8.7N required to break the flap from the container, which remains hingedly connected to the opposing face of the prism as shown at hingepoint 304.

The minimal required opening force, and the upward direction in which it is applied, minimize bending moments applied to the container. This, combined with the appropriate material selection, resulted in successful testing with no bending or deflection failure during testing.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A method for storing and dispensing a flowable material without bimanual synergy, the method comprising the steps of:

forming a sleeve of triangular shape from a single sheet of material;

sealing the longitudinal edges of the sheet to form a longitudinal seam along one edge of the sleeve;

sealing a first end of the sleeve to form a flattened base;

filling the sleeve with a flowable material;

sealing a second end to contain the flowable material within the sleeve;

providing a score on the sleeve, the score proximal to the first end and the score rupturable to provide an opening upon application of more than a predetermined threshold force by a user to the longitudinal seam of the sleeve in a pressure application region of the sleeve between the score and the first end, wherein the threshold force is between 1 and 100 Newtons, wherein the distance between the first end and the score is sufficient for the user to place one of the user's thumbs thereon but is no greater than the distance between the center of the sleeve and the first end, so that the sleeve can be grasped in the fist of a single hand with the score being above the fist, wherein the sleeve is configured such that, with the user grasping the sleeve in the fist with the score being above the fist and the fist providing an opposing force to that provided by the thumb of the user, the force solely of the user's thumb, when applied to the pressure application region of the sleeve, is sufficient to cleanly rupture the sleeve at the score, and wherein the sleeve is made of material having suitable rigidity to resist bending during application of the threshold force.

2. The method of claim 1, wherein the step of forming a sleeve comprises:

forming the sleeve by extruding, casting, folding or sealing one or more layers of one or more materials into the sleeve.

3. The method of claim 1, wherein the step of sealing the sleeve comprises folding, crimping, gluing, heating, application of pressure, application of ultraviolet light, or application of a chemical agent.

4. The method of claim 1, wherein the score is created by thermal, mechanical, ultraviolet, laser means or by application of a chemical agent.

5. The method of claim 1, wherein the score extends around a diameter of the sleeve.

6. The method of claim 1, wherein a region of the sleeve opposing the pressure application region remains hingedly attached to the sleeve after the predetermined threshold force opening the sleeve is applied.

7. The method of claim 1, further comprising the step of:

forming a notch in the seam of the sleeve in the region of the score, such that the user may apply pressure to the notch to facilitate rupture of the sleeve.

8. The method of claim 1, wherein the score lies in a common plane.

9. The method of claim 1, wherein when the user positions the first end of the sleeve vertically above the second end of the sleeve, the flowable material is positioned below the score, whereby, when the sleeve is ruptured by the user's thumb, spillage of the flowable material is minimized.

10. A method for storing and dispensing a flowable material without bimanual synergy, the method comprising the steps of:

providing a sleeve with a tubular structure;

sealing the longitudinal edges of the sleeve to form a longitudinal seam along one edge of the sleeve;

sealing a first end of the sleeve;

filling the sleeve with a flowable material;

sealing a second end to contain the flowable material within the sleeve;

providing a score on the sleeve, wherein the score lies on a common plane, the score proximal to the first end and the score rupturable to provide an opening upon application of more than a predetermined threshold force by a user against the first end, wherein the threshold force is between 1 and 100 Newtons, wherein the distance between the first end and the score is sufficient for the user to place one of the user's thumbs thereon but is no greater than the distance between the center of the sleeve and the first end, so that the sleeve can be grasped in the fist of a single hand with the score being above the fist, wherein the sleeve is configured such that, with the user grasping the sleeve in the fist with the score being above the fist, the force solely of the user's thumb, when applied to a pressure application region of the sleeve, is sufficient to cleanly rupture the sleeve at the score, and wherein the sleeve is made of material having suitable rigidity to resist bending during application of the threshold force.

11. The method of claim 10, wherein the tubular structure is a triangular shape formed from a single sheet of material.

12. The method of claim 10, wherein the user applies the predetermined threshold force to the longitudinal seam in the pressure application region of the sleeve between the score and the first end.

13. The method of claim 10, wherein when the user grasps the sleeve in a fist, the fist provides an opposing force to that provided by the thumb of the user.

14. The method of claim 10, wherein a region of the sleeve opposing the pressure application region remains hingedly attached to the sleeve after the predeterminded threshold force opening the sleeve is applied.

15. The method of claim 10, further comprising the step of:

forming a notch in the seam of the sleeve in the region of the score, such that the user may apply pressure to the notch to facilitate rupture of the sleeve.

16. The method of claim 10, wherein when the user positions the first end of the sleeve vertically above the second end of the sleeve, the flowable material is positioned below the score, whereby, when the sleeve is ruptured by the user's thumb, spillage of the flowable material is minimized.

* * * * *